US005388280A

United States Patent [19]

Sim

[11] Patent Number: 5,388,280

[45] Date of Patent: Feb. 14, 1995

[54] VENTILATION TOILET ASSEMBLY FOR USE IN A RECREATION VEHICLE

[76] Inventor: Jae K. Sim, 5021 Crescent Dr., Anaheim, Calif. 92807

[21] Appl. No.: 134,883

[22] Filed: Oct. 13, 1993

[51] Int. Cl.[6] ..... E03D 9/05

[52] U.S. Cl. ..... 4/213; 4/209 R; 251/129.16; 251/129.2

[58] Field of Search ..... 4/209 R, 216, 210, 213, 4/347, 352, 460, 211; 251/129.16, 129.2

[56] References Cited

U.S. PATENT DOCUMENTS

| | | | |
|---|---|---|---|
| 472,461 | 4/1892 | Lundstedt | 251/129.16 |
| 1,630,263 | 5/1927 | Gravel | 251/129.16 |
| 2,121,392 | 6/1938 | Ashworth | 251/129.16 |
| 2,227,920 | 1/1941 | Baither . | |
| 2,297,935 | 10/1942 | Baither . | |
| 2,329,221 | 9/1943 | Sanford . | |
| 2,443,705 | 6/1948 | Fitzgerald . | |
| 2,575,778 | 11/1951 | Wilson . | |
| 2,817,099 | 12/1957 | Fitzgerald . | |
| 2,847,682 | 8/1958 | Shay . | |
| 3,495,282 | 2/1970 | Taggart . | |
| 3,805,304 | 4/1974 | Ikehata . | |
| 3,982,562 | 9/1976 | Pickett | 251/129.16 |
| 4,133,060 | 1/1979 | Webb | 4/352 |
| 4,222,129 | 9/1980 | Baker . | |
| 4,232,406 | 11/1980 | Beeghly et al. . | |
| 4,318,192 | 3/1982 | Williams et al. . | |
| 4,365,361 | 12/1982 | Sanstrom . | |
| 4,446,889 | 5/1984 | Sakakibara et al. | 251/129.16 |
| 4,494,255 | 1/1985 | Drummond . | |
| 4,551,865 | 11/1985 | Waters | 4/209 R |
| 5,005,222 | 4/1991 | Sim . | |
| 5,044,018 | 9/1991 | Gandini | 4/216 |
| 5,054,131 | 10/1991 | Sim . | |
| 5,079,782 | 1/1992 | Sim . | |
| 5,139,655 | 8/1992 | Sigler . | |
| 5,167,039 | 12/1992 | Sim . | |

*Primary Examiner*—Henry J. Recla
*Assistant Examiner*—Gregory M. Vidovich
*Attorney, Agent, or Firm*—Birch, Stewart, Kolasch & Birch

[57] ABSTRACT

A toilet assembly for use in recreation vehicles, which comprises an air tube member, a flapper valve, and an on/off switch whereby while the user sits on the toilet seat ring, the objectionable odor is effectively ventilated and when the user stands up, the objectionable odor does not flow backward.

5 Claims, 3 Drawing Sheets

VENTILATION TOILET ASSEMBLY FOR USE IN A RECREATION VEHICLE

BACKGROUND OF THE INVENTION

1. Field of the Invention

The present invention relates to a ventilation toilet assembly for use in a recreation vehicle and more particularly, a toilet assembly including an air tube member whereby while the user sits on a seat ring, any objectionable odor is effectively ventilated and when the user stands up, the objectionable odor does not flow upstream.

2. Description of Related Art

Various types of ventilating toilets for use in recreation vehicles are generally known in the art to be utilized with a fan for ventilating contaminated air through a separate exhaust duct.

However, these toilets suffer from a number of problems such as, for example, (1) the waste product and associated objectionable odor does not clearly discharge directly to the sewer discharge line since the ventilating conduit is directly connected to the sewer discharge line, and (2) these conventional toilets are very complicated in structure, expensive to manufacture, and difficult to use.

Such toilets are described in Baither, U.S. Pat. No. 2,227,920; Baither, U.S. Pat. No. 2,297,935; Sanford, U.S. Pat. No. 2,329,221; Fitzgerald, U.S. Pat. No. 2,443,705; Wilson, U.S. Pat. No. 2,575,778; Fitzgerald, U.S. Pat. No. 2,817,099; Shay, U.S. Pat. No. 2,847,682; Taggart, U.S. Pat. No. 3,495,282; Ikehata, U.S. Pat. No. 3,805,304; Baker, U.S. Pat. No. 4,222,129; Beeghly et al., U.S. Pat. No. 4,232,406; Williams et al., U.S. Pat. No. 4,318,192; Sanstrom, U.S. Pat. No. 4,365,361; Drummond, U.S. Pat. No. 4,494,255; and Higgins, U.S. Pat. No. 4,865,664.

In order to avoid these problems, U.S. Pat. No. 5,005,222, issued to the present inventor, discloses a toilet assembly which includes a toilet stool having a ventilation conduit disposed adjacent to the back wall portion of the toilet stool wherein the ventilation conduit extends angularly around a siphon conduit at the point where they communicate with a sewer discharge line, a fan member disposed in the lower portion of the ventilation conduit, a toilet water holding tank having a motion sensor disposed on the front exterior thereof and free of interference from the opening and closing of a toilet seat cover, a multifunctional tube having a U-shaped configuration and disposed in the toilet holding tank, and a movable ball valve disposed to move in the multifunctional tube for allowing exhaust gas to flow from a flush ring to the ventilation conduit or flush water to flow from the toilet holding tank to the toilet bowl, whereby upon opening the toilet seat cover, while the user sits on the seat ring, the motion sensor actuates the fan member allowing the objectionable odor to be ventilated, and in turn when the user stands up and flushes the toilet assembly, the motion sensor deactivates and simultaneously the flush water discharges the waste products and associated objectional odor directly to the sewer discharge line.

Another U.S. Pat. No. 5,079,782 issued to the present inventor, discloses a toilet assembly which includes a toilet stool having ventilation conduit disposed adjacent to the back wall portion of the toilet stool and a gas exhaust duct connected to the ventilation conduit and having a raised portion disposed at the interior surface thereof for allowing exhaust gas to flow from a flush ring to the ventilation conduit, said raised portion being provided with a water exiting tube for preventing the flush water from the water exiting tube from flowing into the ventilation conduit, whereby the flush water discharges the waste products and associated objectionable odor directly to the sewer discharge line.

A further U.S. Pat. No. 5,054,131 issued to the present inventor, discloses a toilet assembly which includes a toilet stool having a ventilation conduit disposed adjacent to the back wall portion of the toilet stool and a U-shaped exhaust duct disposed in the toilet holding tank and connected to the ventilation conduit for allowing exhaust gas to flow from a flush ring to the ventilation conduit, whereby the flush water discharges the waste product and associated objectionable odor directly to the sewer discharge line.

Still another U.S. Pat. No. 5,167,039 issued to the present inventor, discloses a non-siphon type ventilating toilet assembly which includes a U-shaped ventilation tube disposed in the toilet holding tank for ventilating objectionable odor from the toilet bowl. The ventilation tube contains a cap valve which moves upwardly and downwardly along an outer-screwing shaft of an upper motor and a fan of a side motor. Both motors are connected to a motion sensor, whereby upon opening the toilet seat cover having a sensor aperture and sitting by the user on the seat ring, the motion sensor actuates, allowing both motors to be operated and simultaneously open the cap valve so that the objectionable odor is ventilated. In turn when the user stands up and flushes the toilet assembly, the motion sensor deactivates, allowing both motors to be stopped and simultaneously closing the cap valve and the flush water discharges the waste products to the sewer discharge line.

The present inventor is also prosecuting another U.S. patent application, Ser. No. 08/095,003, filed Jul. 23, 1993, which discloses a toilet assembly having a combined automatic ventilation and flushing system, which comprises a returnable solenoid member, a trap way, a trap way valve member, a multifunctional tube member, and a motion sensor whereby while the user sits on the toilet seat ring, the objectionable odor is effectively ventilated and when the user stands up, the toilet assembly is automatically flushed.

However, these toilet assemblies do not achieve a perfect discharge of the objectionable odor and are somewhat complicated in construction. In addition, these toilet assemblies do not disclose or suggest their use in recreation vehicles.

SUMMARY OF THE INVENTION

Accordingly, it is an object of the present invention to provide an improved ventilation toilet assembly for use in a recreation vehicle whereby objectionable odor from the toilet bowl is effectively flushed and ventilated therefrom, and discharged into a sewer discharge line, which eliminates the above problems encountered in a conventional toilet assembly.

Another object of the present invention is to provide a toilet assembly which includes a large odor air valve and a large motor fan whereby the objectionable odor is effectively ventilated and noise of the motor fan can be readily reduced.

A further object of the present invention is to provide a toilet assembly which includes a separate U-shaped air conduit so that the ventilation of the toilet assembly of the present invention is effectively performed.

Still another object of the present invention is to provide an improved toilet assembly which includes a an on/off switch for ventilation and an odor air valve member, whereby upon opening the toilet seat cover, while the user sits on the seat ring, the on/off switch is in an on position for triggering an electromagnet and opening the odor air valve so that the objectionable odor is ventilated, and in turn, when the user stands up, the on/off switch is in an off position for enabling a closing of the odor air valve so that the objectionable odor does not flow backward.

Still another object of the present invention is to provide a toilet assembly which is simple in structure, inexpensive to manufacture, durable in use, and refined in appearance.

Other objects and further scope of applicability of the present invention will become apparent from the detailed description given hereinafter. However, it should be understood that the detailed description and specific examples, while indicating preferred embodiments of the invention, are given by way of illustration only, since various changes and modifications within the spirit and scope of the invention will become apparent to those skilled in the art from this detailed description, Briefly described, the present invention relates to a toilet assembly for use in recreation vehicles which comprises an air tube member, a water valve, and an on/off switch whereby while the user sits on the toilet seat ring, the objectionable odor is effectively ventilated and when the user stands up and the toilet assembly is not in use, the objectionable odor does not flow backward.

BRIEF DESCRIPTION OF THE DRAWINGS

The present invention will become more fully understood from the detailed description given hereinbelow and the accompanying drawings which are given by way of illustration only, and thus, are not limitative of the present invention, and wherein.

DESCRIPTION OF THE PREFERRED EMBODIMENTS

Figure 1:
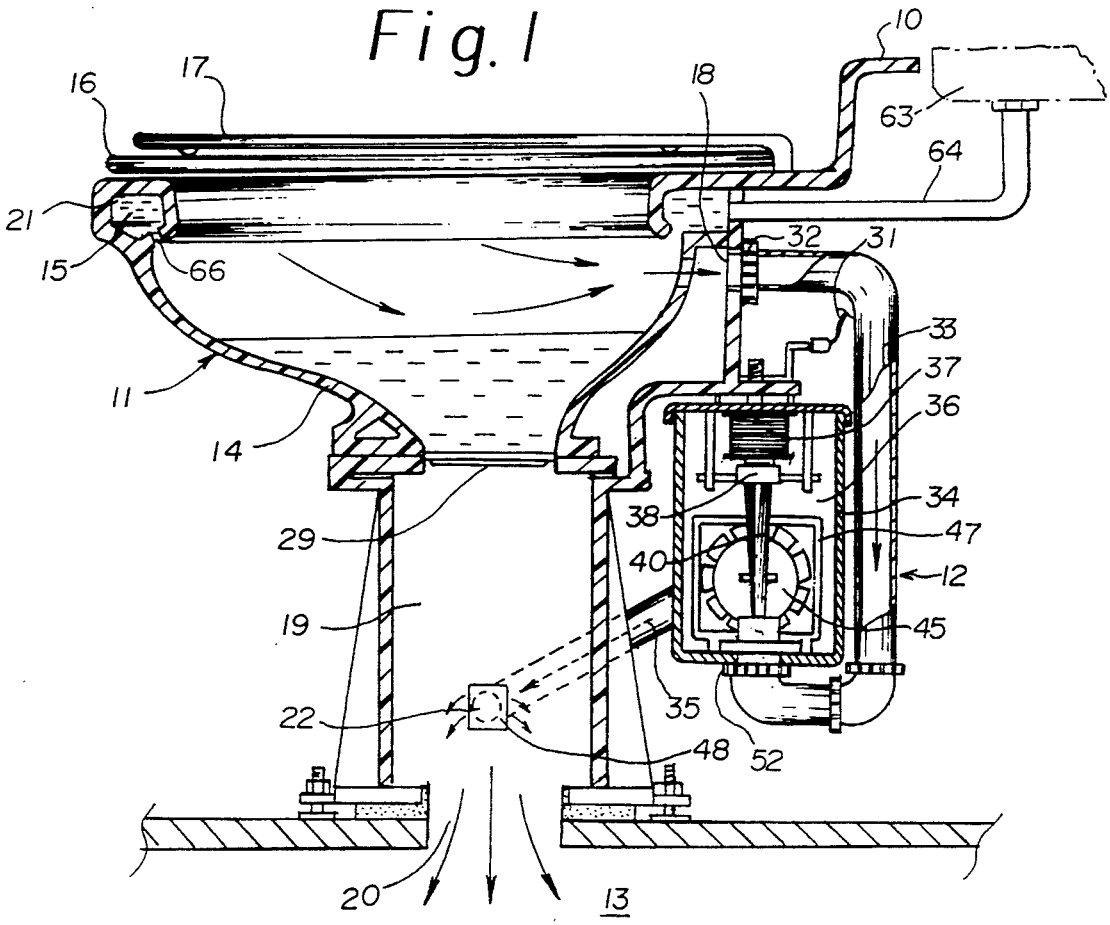
FIG. 1 is a sectional view of the ventilation toilet assembly according to the present invention.
Figure 2:
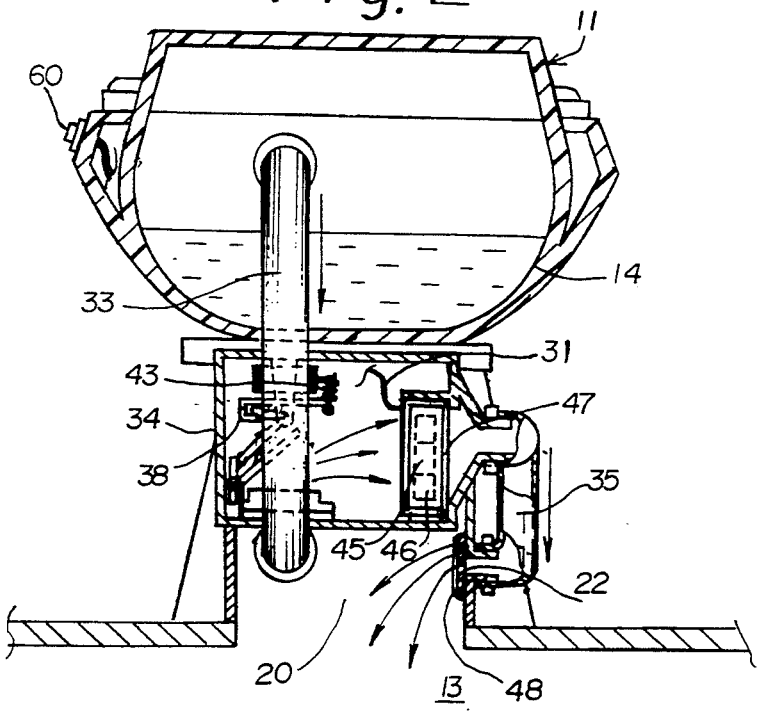
FIG. 2 is a rear view of the ventilation toilet assembly according to the present invention containing cut-away portions in order to illustrate the construction of the toilet assembly of the present invention.

Referring now in detail to the drawings for the purpose of illustrating preferred embodiments of the present invention, the toilet assembly as shown in FIGS. 1 and 2, comprises a vehicle frame 10 and a toilet stool 11 attached to the vehicle frame 10 of a recreation vehicle (not shown).

The toilet stool 11 includes a toilet bowl 14 having a main tunnel 15 disposed at the upper portion of the toilet bowl 14 for allowing fresh flush water 21 to be flushed into the toilet bowl 14 and a seat ring 16 operatively located on the top of the toilet bowl 14. The toilet stool 11 further includes a toilet seat cover 17 being pivotally connected to the seat ring 16 by pivotal hinges (not shown). A passage 19 is disposed in the toilet bowl 14 and communicates with a water flow backward protecting member 48 and an outlet 22 of a downward tube 35 for discharging waste products and associated objectionable odor directly from the toilet bowl 14 to a sewer discharge line 20 of a holding tank 13.

The toilet water holding tank 63 contains the water 21 to be flushed via water hose 64 into the toilet bowl 14 through the main tunnel 15 of the toilet stool 11.

As shown in FIGS. 1 and 2, an air tube member 12 includes a U-shaped main tube 33 communicated with the upper portion of the toilet stool 14 through an opening 18 and an inlet 32, a housing 34 disposed between the toilet stool 14 and the main tube 33, a bottom aperture 52 communicating with the end of the main tube 33, and the downward tube 35 extending from the housing 34 to be communicated with the passage 19 of the toilet stool 11. The housing 34 contains a plurality of bolts 30 shown in FIG. 3.

Figure 3:
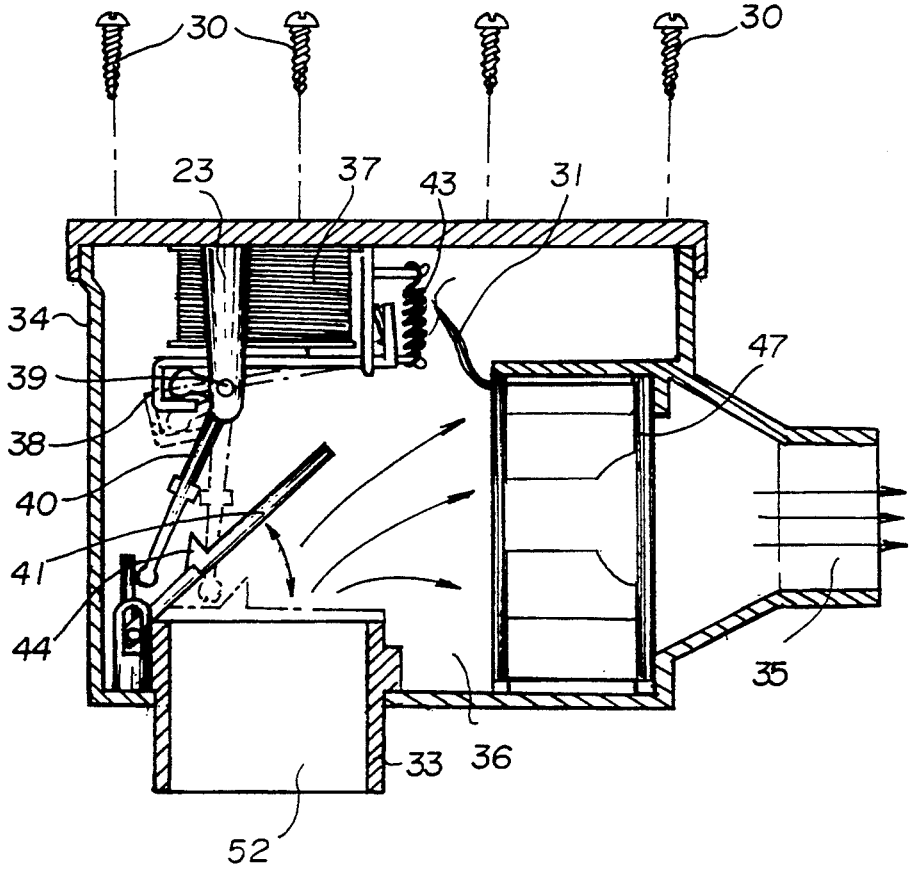
FIG. 3 is an enlarged rear view of a pocket member of the ventilation toilet assembly according to the present invention.
Figure 5A:
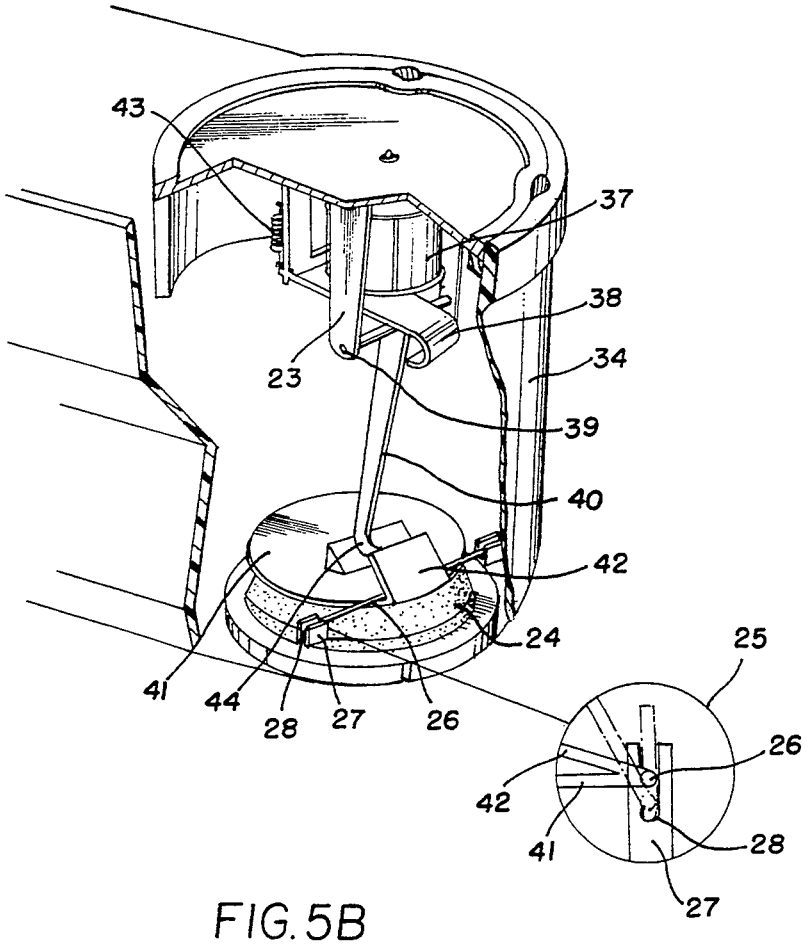
FIG. 5A is a perspective view of an odor air valve member containing cut-away portions in order to illustrate the construction thereof in a closed position and including an enlarged detailed view of an air valve hinge according to the present invention.
Figure 5B:
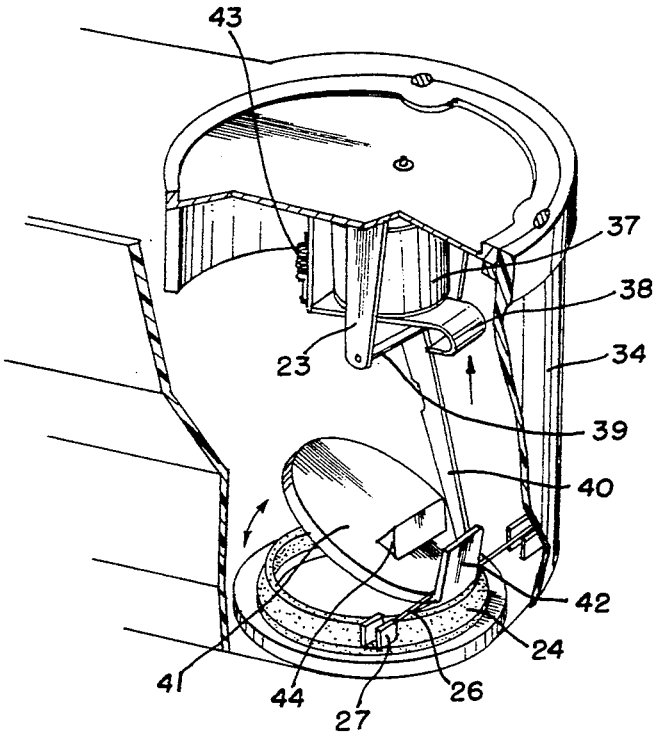
FIG. 5B is a perspective view of the odor air valve member containing cut-away portions in order to illustrate the construction thereof in an open position according to the present invention.

As shown in FIGS. 3, 5A, and 5B, an odor air valve member 36 of the tube member 12 includes an electromagnet 37 operatively associated with a C-shaped contacting plate 38 to be attached to the electromagnet 37 when the electromagnet 37 is activated by an on/off switch 60 (in FIG. 2). The odor air valve member 36 also includes a lever 40 inwardly hooked at both ends, and an odor air valve plate 41 having an odor air valve handle 44 for operatively connecting with one end of the hooked lever 40 so as to open the odor air valve plate 41 (FIG. 5B). The lever 40 is easily pivoted about a first pivot pin 39 pivotally supported by a pivot pin support 23 of the odor air valve member 36. The electromagnet 37 is provided with electric wires 31.

As shown in FIG. 5A, when the electric source with DC 12 volts is in an off-position, the contacting plate 38 is returned to an original position by biasing spring 43 (FIG. 3). Therefore, the contacting plate 38 pushes the upper end portion of the hooked lever 40 down and simultaneously, the lower end portion of the lever 40 moves from the valve handle 42 and moves to the odor air valve plate 41 through a trihedron 44 whereby the odor air valve plate 41 is tightly closed against a rubber gasket top opening 24 of the main tube 33. As shown in an enlarged drawing of FIG. 5A, a hinge member 25 of the odor air valve member 36 includes a valve rod 26 attached to the connecting portion of the air valve plate 41 and air valve handle 42, a pair of rod seats 27, and a groove 28 of each rod seat 27 for movably receiving the valve rod 26 depending on opening and closing of the odor air valve plate 41.

When the on/off switch 60 is in the on position, the electromagnet 37 actuates, the odor air valve plate 41 opens and simultaneously, a fan motor 45 with electric wires 31 and a fan 46 disposed within a fan motor housing 47 operates, the odorous air or exhaust gas flows to the downward tube 35 through the main tube 33. Therefore, the odorous air or exhaust gas flow to the holding tank 13 through the main tube 33.

Figure 4:
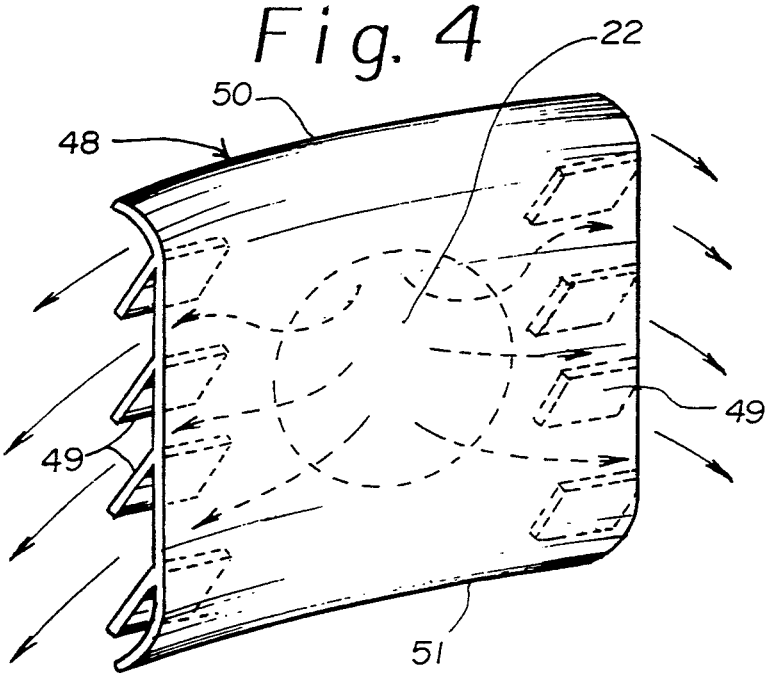
FIG. 4 is a perspective view of a water flow backward protecting member of the ventilation toilet assembly according to the present invention.

As shown in FIG. 4, the water flow backward protecting member 48 includes a top bent portion 50, a bottom bent portion 51, and a pair of slope wings 49, which are attached to the outlet 22 for smoothly exhausting objectionable odor and protecting water 15 from flowing backward.

According to the present invention, the toilet assembly operates as follows. First of all, upon opening the toilet seat cover 17, while the user sits on the seat ring 16, the on/off switch 60 is in the on position for allowing the electromagnet 37 to be actuated and simultaneously the electromagnet 37 pulls the contacting plate 38 up. Therefore, the odor air valve plate 41 is opened (FIG. 5B) by pushing the odor air valve 42 through both ends of the inwardly hooked lever 40.

Accordingly, the objectionable odor is evacuated from the toilet bowl 14 through the opening 18 in the direction indicated by real line arrows shown in FIGS. 1, 2, and 3 and the main tunnel 15 is ventilated into the main tube 33 and the downward tube 35 through the housing 34 and discharged to the passage 19 and then the objectionable odor is directly discharged to the sewer line 20 and the holding tank 13 through the outlet 22 and the waterflow backward protecting member 48 (FIGS. 1 and 2).

In turn, when the user stands up and pushes a pedal for flushing and opening the water valve 29, the on/off switch 60 is in an off-position for ventilation so that the electromagnet 37 deactivates and the contacting plate 38 moves down to tightly close the odor air valve plate 41 against the rubber gasket top opening 24. Simultaneously, the water valve 29 is open and the fresh flush water 21 flows to the toilet bowl 19 from the toilet water tank 63 through a plurality of openings 66 of the main tunnel 15. At this time, sometimes, when the water 15 flows backward, the plurality of wings 49 of the waterflow backward protecting member 48 can protect the water from flowing backwards.

At this time, the electromagnet 37 is deactivated by the off-position of the electric source for ventilation and the odor air valve plate 41 is in a closed state (FIG. 5A). Therefore, the flush water effectively discharges the waste product and associated objectionable odor directly to the sewer discharge line 20 through the passage 19.

Accordingly, the air tube member 12 according to the present invention can effectively ventilate the nauseating odor while the user uses the toilet assembly, in turn, while the user does not use the toilet assembly the nauseating odor can be effectively prevented from flowing upstream.

Thus, the toilet assembly of the present invention is simple in construction, compact for portability, inexpensive to manufacture, durable in use, and refined in appearance.

The invention being thus described, it will be obvious that the same may be varied in many ways. Such variations are not to be regarded as a departure from the spirit and scope of the invention, and all such modifications as would be obvious to one skilled in the art are intended to be included within the scope of the following claims.

What is claimed is:

1. A ventilating toilet assembly for use in a recreational vehicle, said toilet assembly comprising:

a toilet bowl, a water flush guiding tunnel communicating with said bowl for allowing flush water to be flushed into the toilet bowl, a toilet seat adapted to be disposed about an upper periphery of said bowl, a toilet seat cover adapted to be disposed on the peripheral top of said toilet seat, an on/off switch disposed on said bowl, an outlet disposed in said bowl for discharging waste products to a discharge line, a water valve disposed in said outlet for controlling the discharge of waste products and water from said bowl, and a passage in said bowl above a normal water level in said bowl for ventilating air within said bowl;

said assembly further comprising an air tube member having first and second ends disposed adjacent said toilet bowl, said first end of said member communicating with said passage in said bowl, said second end of said member communicating with said discharge line, said air tube member including:

a housing;

a downward tube having first and second ends, said first end of said downward tube operatively connected with said housing, said second end of said downward tube adapted to be connected to said discharge line;

a U-shaped main tube having first and second ends, said first end of said U-shaped tube connected to said passage, said second end of said U-shaped tube connected to a bottom aperture disposed on a lower portion of said housing;

said housing further including an odor air valve member disposed in said housing, said odor air valve member having an electromagnet connected to a surface within said housing, a contacting plate having means for supporting said contacting plate adjacent said electromagnet, a lever having a first hook-shaped end engageable with said contacting plate and a second hook-shaped end, lever support means for supporting said first end of said lever to said housing, an air valve plate having a lower surface adapted to cover said bottom aperture to provide an air seal between said housing and said second end of said U-shaped tube, a main valve handle connected to a top surface of said air valve plate wherein said second hooked-shaped end is engageable with said main valve handle, and a fan motor with a fan;

said on/off switch operatively connected to said electromagnet and said fan motor and being operative between an on position for ventilating said toilet bowl and allowing said electromagnet and said fan motor to be operated such that said contacting plate moves toward said electromagnet, thereby engaging said first hooked shaped end of said lever which causes said second hooked shaped lever to engage said main valve handle to open said air valve plate for allowing ventilation of the toilet bowl through said passage, through said U-shaped tube and through said downward tube to said discharge line and an off position which disengages the operation of said electromagnet and said fan motor to close said air valve plate.

2. The toilet assembly of claim 1 wherein said bottom aperture includes a rubber gasket mounted thereon and said air valve plate includes a trihedron attached on a central upper surface thereof which is adapted to be engaged by said second hooked-shaped end of said lever when said on/off switch is activated to said off position for tightly closing said air valve plate to said rubber gasket.

3. The toilet assembly of claim 2 wherein said air valve plate is provided with a valve rod adapted to engage said top surface of said air valve plate and located between said trihedron and said main valve handle to perform as a hinge for said plate, a pair of rod seats adapted to be connected to said housing, each of said rod seats having a vertical groove therein, said valve rod being disposed within said grooves which allows vertical motion of said valve rod therein according to the closing and opening of said air valve plate.

4. The toilet assembly of claim 1 wherein said lever supporting means includes a pivot pin for allowing pivotal movement of said first end of said lever, wherein when said contacting plate moves toward said electromagnet, said second hooked-shaped end of said lever is biased in a direction opposite from said first hook-shaped end to push said main valve handle to open said air valve plate; said contacting plate further including spring means to bias said contacting plate away from said electromagnet.

5. The toilet assembly of claim 1 wherein said second end of said downward tube includes a water flow backward protecting member attached thereto, said backward protecting member having multiple pairs of slope wings for protecting water entering said discharge line from flowing into said downward tube.

* * * * *